US010934837B2

(12) United States Patent
Segura Dominguez et al.

(10) Patent No.: US 10,934,837 B2
(45) Date of Patent: Mar. 2, 2021

(54) FIBER OPTIC COILED TUBING TELEMETRY ASSEMBLY

(71) Applicant: Schlumberger Technology Corporation, Sugar Land, TX (US)

(72) Inventors: Jordi Juan Segura Dominguez, Richmond, TX (US); Michael Hayes Kenison, Richmond, TX (US); Charles Kearney, Richmond, TX (US); Santiago Hassig Fonseca, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/008,172

(22) Filed: Jan. 27, 2016

(65) Prior Publication Data

US 2017/0211380 A1 Jul. 27, 2017

(51) Int. Cl.
*E21B 47/135* (2012.01)
*E21B 47/12* (2012.01)

(52) U.S. Cl.
CPC ..... *E21B 47/135* (2020.05)

(58) Field of Classification Search
USPC ..... 340/854.7
See application file for complete search history.

(56) References Cited

U.S. PATENT DOCUMENTS 7,515,774 B2 4/2009 Vannuffelen et al.
7,929,812 B2 4/2011 Vannuffelen et al.
2007/0140622 A1* 6/2007 Kenison ..... E21B 17/023 385/76
2009/0071652 A1* 3/2009 Vinegar ..... E21B 36/04 166/303
2009/0224936 A1* 9/2009 Vannuffelen ..... E21B 47/123 340/854.7
2010/0155059 A1 6/2010 Ullah
2011/0088462 A1 4/2011 Samson et al.
2011/0139447 A1* 6/2011 Ramos ..... E21B 47/09 166/254.2
2011/0163891 A1* 7/2011 Wilson ..... G01V 11/002 340/854.9
2014/0270789 A1 9/2014 Coffey
2014/0347192 A1* 11/2014 Barfoot ..... E21B 47/123 340/854.7

(Continued)

OTHER PUBLICATIONS

Office Action issued in U.S. Appl. No. 15/816,180 dated Oct. 17, 2018; 31 pages.

*Primary Examiner* — Curtis A Kuntz
*Assistant Examiner* — Jerold B Murphy
(74) *Attorney, Agent, or Firm* — Rodney Warfford

(57) ABSTRACT

A system for use in carrying out downhole coiled tubing applications with two-way telemetry over a single fiber optic thread. The system includes uphole and downhole assemblies each having unique couplers. Specifically, the couplers may be configured to secure the single fiber optic thread at one end thereof while having dedicated fiber optic channels at another side thereof for interfacing a fiber optic transmitter and receiver. Thus, fiber optic data may travel from a surface assembly over the thread for detection at the downhole assembly simultaneous with fiber optic data travelling from the downhole assembly to the surface assembly over the same thread.

20 Claims, 5 Drawing Sheets

(56) References Cited

U.S. PATENT DOCUMENTS

| | | | | |
|---|---|---|---|---|
| 2016/0097275 | A1* | 4/2016 | Santoso | E21B 47/123 340/854.7 |
| 2017/0096892 | A1 | 4/2017 | Segura et al. | |
| 2017/0211380 | A1 | 7/2017 | Segura Dominguez et al. | |

* cited by examiner

FIBER OPTIC COILED TUBING TELEMETRY ASSEMBLY

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Along these lines, added emphasis has been placed on well logging, profiling and monitoring of conditions from the outset of well operations. Whether during interventional applications or at any point throughout the life of a well, detecting and monitoring well conditions has become a more sophisticated and critical part of well operations.

Such access to the well is often provided by way of coiled tubing. Coiled tubing may be used to deliver interventional or monitoring tools downhole and it is particularly well suited for being driven downhole through a horizontal or tortuous well, to depths of perhaps several thousand feet, by an injector at the surface of the oilfield. Thus, with these characteristics in mind, the coiled tubing will also generally be of sufficient strength and durability to withstand such applications.

In addition to providing access generally, coiled tubing may be utilized as a platform for carrying passive sensing capacity. For example, a fiber optic line may be run through the coiled tubing interior and utilized to acquire distributed measurements, such as distributed temperature, pressure, vibration, and/or strain measurements from within the well. This may be referred to as providing distributed temperature sensing (DTS) and/or heterodyne distributed vibration sensing (hDVS) capacity. In this manner, the deployment of coiled tubing into the well for a given application may also result in providing such additional information in a relatively straight forward manner without any undue requirement for additional instrumentation or effort.

By the same token, given the capacity of the coiled tubing to carry a telemetric line, fiber optics may be utilized for sake of communication, for example, between oilfield equipment and a downhole application tool (e.g. at the bottom or downhole end of the coiled tubing). That is, while a more conventional electric cable may also be utilized for communications, there may be circumstances where a fiber optic line is preferred. For example, an electric cable capable of providing two-way communications between oilfield equipment and a downhole application tool may be of comparatively greater size, weight, and slower communication speeds as compared to a fiber optic telemetric line. This may not be of dramatic consequence when the application run is brief and/or the well is of comparatively shallower depths, say below about 10,000 feet. However, as wells of increasingly greater depths, such as beyond about 20,000 feet or so, become more and more common, the difference in time required to run the application as well as the weight of the extensive electrical cable may be quite significant.

As alluded to above, utilizing a fiber optic line in place of an electric cable may increase communication or data transmission rates as well as reduce the weight of the overall deployed coiled tubing assembly. Once more, a fiber optic line may be more durable than the electric cable in certain respects. For example, where the application to be carried out downhole involves acid injection for sake of cleaning out a downhole location, acid will be pumped through the coiled tubing coming into contact with the telemetric line therethrough. In such circumstances, the line may be more resistant to acid where fiber optics are utilized for the telemetry, given the greater susceptibility of electric lines to damage upon acid exposure.

In spite of the variety of advantages, utilizing a fiber optic line to provide telemetry through the coiled tubing in lieu of an electric line does present certain challenges. For example, given the more common deeper wells of today, it is likely that the fiber optic line would be of an extensive length and require a heat resistant capacity. Indeed, high temperature fiber optic lines are available which are rated for use at over 150° C. However, such fiber optic lines are substantially more expensive on a per foot basis. Once more, with well depths commonly exceeding 20,000 feet and susceptible to extreme temperatures, this means that the line cost is likely to be very expensive. By way of example, in today's dollars it would not be uncommon to see a 22,000 foot fiber optic line with two-way communications approach about $250,000 in cost.

In an effort to reduce the cost of a fiber optic line through a coiled tubing as described above, it is feasible to eliminate certain threads of the line. That is, a conventional two-way fiber optic line would include multiple fiber optic threads. Specifically, one or more threads may provide a downlink for data from the oilfield surface, for example to command a downhole tool whereas one or more threads would provide an uplink for data back to the surface from the tool. Thus in theory, for two-way fiber optic communication, the total threads may be reduced to a total of no more than two (e.g. one dedicated for downlink and the other for uplink).

While some cost reduction might be seen in reducing the number of fiber optic threads perhaps by as much as $60,000 per thread eliminated in the 22,000 foot example, the ability to reduce the line down to a single fiber may not be a practical undertaking at present. For example, it might be feasible to utilize the dedicated thread for uplink communications from the tool and send downlink commands through another mode such as pressure pulse actuation. However, this would result in a downlink signal that might be of poorer quality and require its own dedicated surface controls, therefore driving up equipment cost. Thus, as a practical matter, coiled tubing operators are generally left with the option of either more expensive fiber optic communications or less desirable electric communications.

SUMMARY

A telemetric coiled tubing system. The system includes a surface assembly and a downhole assembly each of which including a fiber optic transmitter, receiver and coupler. Further, a surface unit is coupled to the surface assembly for directing an application in a well over the system whereas a downhole tool is coupled to the downhole assembly for performing the application in the well. Additionally, a fiber optic thread may be run through the coiled tubing of the system and coupled to each of the couplers for simultaneously transmitting fiber optic data from each transmitter to each receiver.

DETAILED DESCRIPTION

In the following description, numerous details are set forth to provide an understanding of the present disclosure. This includes description of the surrounding environment in which embodiments detailed herein may be utilized. In addition to the particular surrounding environment detail provided herein, that of U.S. Pat. Nos. 7,515,774 and 7,929,812, each for *Methods and Apparatus for Single Fiber Optical Telemetry* may be referenced as well as U.S. application Ser. No. 14/873,083 for an *Optical Rotary Joint in Coiled Tubing Applications*, each of which is incorporated herein by reference in their entireties. Additionally, it will be understood by those skilled in the art that the embodiments described may be practiced without these and other particular details. Further, numerous variations or modifications may be employed which remain contemplated by the embodiments as specifically described.

Embodiments are described with reference to certain tools and applications run in a well over coiled tubing. The embodiments are described with reference to particular cleanout applications utilizing acid and a cleanout tool at the end of a coiled tubing line. However, a variety of other applications may take advantage of embodiments of coiled tubing telemetry assemblies as detailed herein. Indeed, so long as the system includes surface and downhole assemblies each outfitted with a fiber optic transmitter, receiver and coupler; a single fiber optic thread may be run therebetween for two-way communications and allowing appreciable benefit to be realized as a result.

Figure 1:
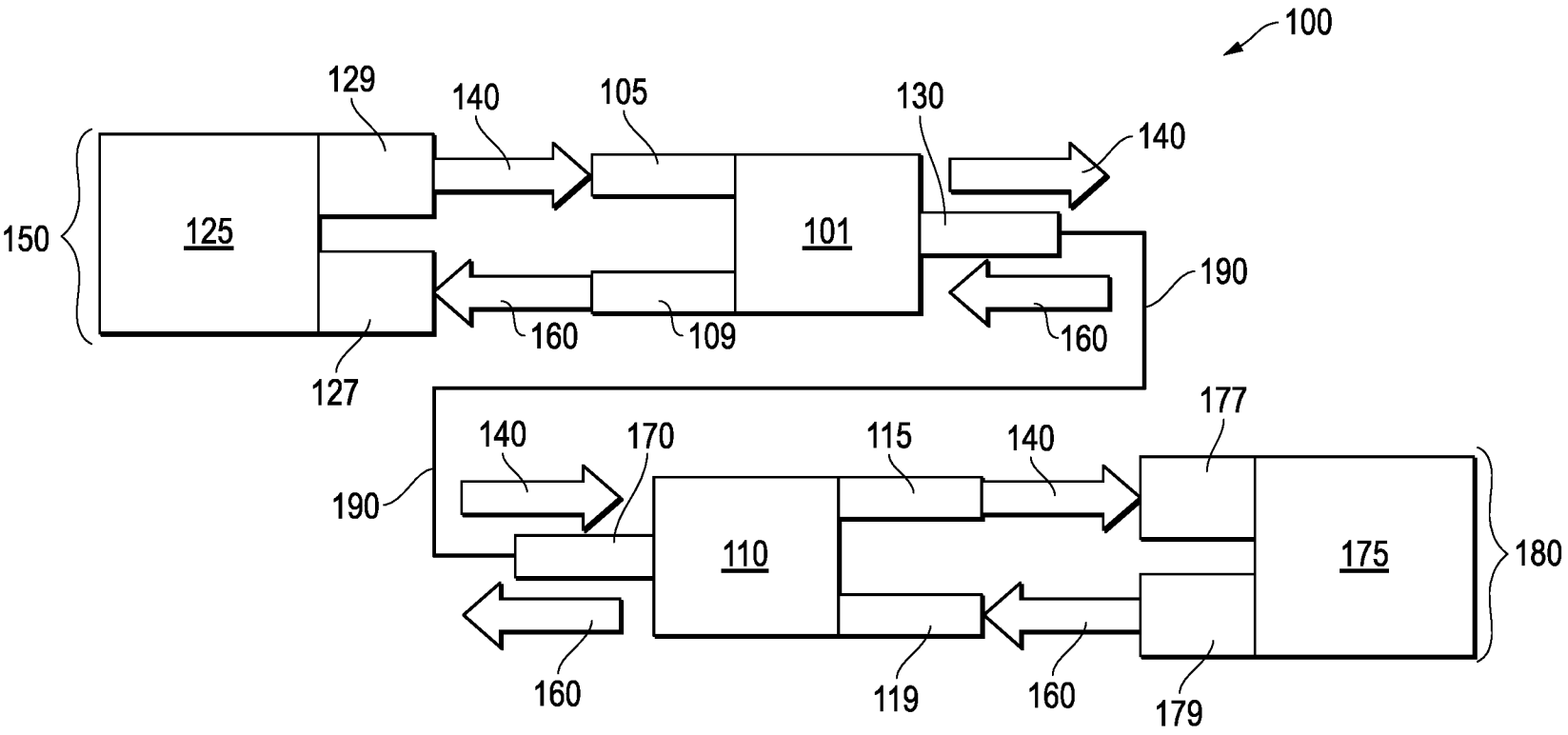
FIG. 1 is a schematic view of a coiled tubing system with surface and downhole assemblies coupled together via a single fiber optic thread for communication.

Referring specifically now to FIG. 1, a schematic view of a coiled tubing system 100 is shown with surface 150 and downhole 180 assemblies. The surface assembly 125 includes surface equipment 125 with a fiber optic light transmitter 129, receiver 127 and other features for positioning at an oilfield 400 such as that depicted in FIG. 4. The downhole assembly 180, for locating in a well 480, similarly includes a downhole tool 175 with its own fiber optic light transmitter 179 and receiver 177 (again see FIG. 4). Notably though, the system 100 also includes a single optical fiber or fiber optic thread 190 to allow for two-way telemetry thereover. Specifically, a single thread 190 may be run through a well 480 and several thousand feet of coiled tubing 410 (again see FIG. 4). As detailed below, this may be achieved through use of uphole 101 and downhole 110 couplers.

Each coupler 101, 110 may be equipped with a common fitting 130, 170 for securing the single thread 180 at the well side thereof. Further, the uphole coupler 101 includes a dedicated downlink channel 105 coupled to the light transmitter 129 and a dedicated uplink channel 109 coupled to the receiver 127. Similarly, the downhole coupler 110 includes a dedicated downlink channel 115 coupled to a receiver 177 and a dedicated uplink channel 119 coupled to a fiber optic transmitter 179. Ultimately, this means that downlink fiber optic light or signal 140 may pass from the uphole fiber optic light transmitter 129 and into the shared fiber optic thread 190 eventually emerging at the downhole receiver 177 via the couplers 101, 110. As noted, the thread 190 is shared for two-way communications as described further below. Thus, uplink fiber optic light or signal 160 may simultaneously be transmitted from the downhole fiber optic light transmitter 179 and into the thread 190 eventually emerging at the uphole receiver 127 via the couplers 101, 110. As a practical matter, this means that surface equipment 125 of the uphole assembly may send data to a downhole tool 175 and the tool 175 may send data back to the equipment 125 over the very same fiber optic thread 190, simultaneously.

The above described couplers 101, 110 allow for the passage of fiber optic light 140, 160 in both directions over the thread 190 at the same time. For example, the channels 105, 115 supporting downlink light 140 need not be structurally maintained separate and apart from the channels 109, 119 supporting uplink light 160 throughout the entire length of the system 100. Instead, within the uphole coupler 101 the uphole channels 105, 115 may be brought to interface with one another and physically merge with the single fiber optic thread 190. Similarly, within the downhole coupler 110, the downhole channels 115, 119 may also be brought into physical interface with one another and merge with the same thread 190 at the downhole end thereof.

Unlike electrical current, or other forms of data transfer, merging the optical pathways of both the downlink light 140 and uplink light 160 into the same shared thread 190 does not present an interference issue. That is, the two different lights 140, 160, each headed in opposite directions do not impede one another.

Other measures may be taken to ensure that the downlink light 140 reaches the downhole receiver 177 and the uplink light 160 reaches the uphole receiver 127. These measures may include tuning the receivers 127, 177 to particular wavelengths of light detection or interfacing each receiver 127, 177 with filters to substantially eliminate the detection of unintended light or both. For example, in a non-limiting embodiment, the downlink light 140 may be emitted by the uphole transmitter 129 at 1550 nm of wavelength whereas the uplink light 160 may be emitted by the downhole transmitter 179 at a 1310 nm wavelength. In this case, the transmitters 129, 179 may be conventional laser diodes suitable for emitting such wavelengths. Regardless, even if 1550 nm light 140 from the uphole transmitter 129 reflects back toward the uphole receiver 127, detection thereof may be substantially avoided due to tuning of the receiver 127 to receive 1310 nm light and filter out 1550 nm light.

Even the use of wavelengths that are 200 or more nm apart in wavelength may further aid in avoiding such crosstalk detections by the receiver 229. Indeed, in an embodiment, the wavelengths may be even further separated, for example with the uplink light 160 being 810 nm in contrast to the downlink light 140 of 1550 nm (or vice versa). Of course, in this same embodiment, the downhole receiver 177 is afforded the same type of tuning and/or filtering to help ensure proper detection of 1550 nm light 140 to the substantial exclusion of 1310 nm light.

Continuing with reference to FIG. 1, the couplers 101, 110 may be of a wavelength division multiplexing (WDM) configuration which is particularly adept at avoiding crosstalk as described above. Thus, in addition to tuning and filtering, the type of coupler 101, 110 may also help ongoing communications. This may be of particular importance depending on the age of the system 100 and thread 190 in particular. That is, as signal attenuation becomes greater over the life of the fiber optic thread 190, the strength of the fiber optic signals therethrough may naturally reduce. However, this attenuation does not necessarily apply to light that is reflected through a coupler 101, 110 and back toward its origin (e.g. light 140 from the uphole transmitter 129 and back to the uphole receiver 127). Thus, the use of a WDM coupler 101, 110 to minimize the amount of such reflected light and insertion loss in combination with filtering and tuning of the receiver 127 may substantially eliminate the detection of crosstalk.

Figure 2:
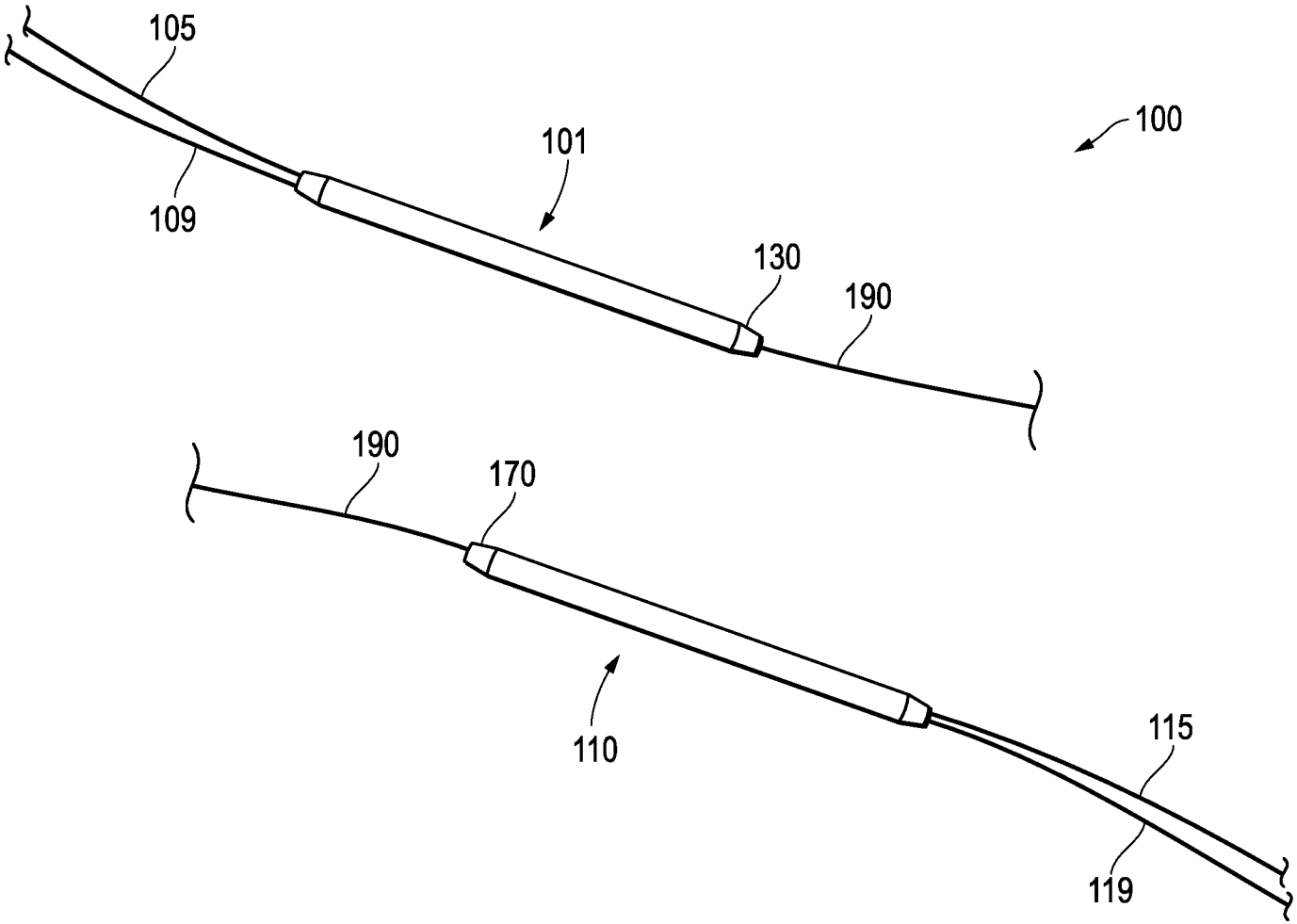
FIG. 2 is a perspective view of a surface coupler and a downhole coupler of the system for the surface and downhole assemblies of FIG. 1, respectively.

Referring now to FIG. 2, a perspective view of embodiments of a surface coupler 101 and a downhole coupler 110 are shown as they might appear to an operator assembling the system 100 of FIG. 1. In this view, a jacketed optical fiber or fiber optic thread 190 suitable for downhole use runs between the common fittings 130, 190 of the couplers 101, 110.

With added reference to FIG. 1, inside the body of each coupler 101, 110, fiber optics are merged as detailed above. Specifically, separate fiber optic channels 105, 109 emerge from surface features and come into interface with one another and the thread 190 within the body of the surface coupler 101. Thus, as the thread 190 emerges from the surface common fitting 130, it carries light 140 from a surface fiber optic light transmitter 129 as detailed above. However, the thread 190 also serves as a platform for light 160 back to the channel 109 in communication with a surface receiver 127.

As with the surface components, separate downhole fiber optic channels 115, 119 emerge from downhole features, for example in communication with a downhole tool 175. Again though, these separate channels 115, 119 come into interface with one another and the fiber optic thread 190 within the body of the downhole coupler 110. Thus, as the thread 190 emerges from the downhole common fitting 170, it carries light 160 from a downhole transmitter 179 as detailed above while also serving as a platform for downlink light 140 headed toward the downhole receiver 177.

Continuing with reference to FIG. 2, the fiber optic thread 190 may be jacketed as indicated to withstand a downhole environment. Additionally, the fiber itself may be multimode or single-mode and of a high temperature rating (e.g. over 150° C.). Further, the channels 105, 109 and/or 115, 119 may be incorporated directly into or coupled to a single module-type package that includes the transmitter 129, 179 and the receiver 127, 177 for ease of assembly, perhaps at the oilfield 400 (see FIG. 4). Thus, operators may have some flexibility when determining the necessary length and assembly of the overall system 100 for the application to be run.

Figure 3A:
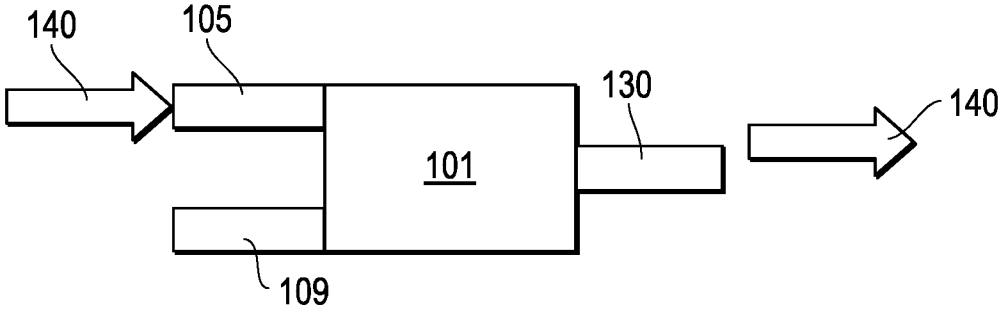
FIG. 3A is a schematic view of the surface coupler of FIG. 2 for routing of data downhole.

Referring now to FIG. 3A, a schematic view of the surface coupler 101 of FIG. 2 for routing of data downhole via downlink fiber optic light 140 is shown. It is worth noting that the channel 105 for routing this light 140 is commensurate with the common fitting 130. That is, as opposed to being split, the light signal 140 is routed to the common fitting 130 and on to the fiber optic thread 190 as shown in FIG. 2. Further, as indicated above, the coupler 101 may be of a WDM variety. Thus, the strength of the signal may undergo no substantial loss as it traverses through the coupler 101.

Figure 3B:
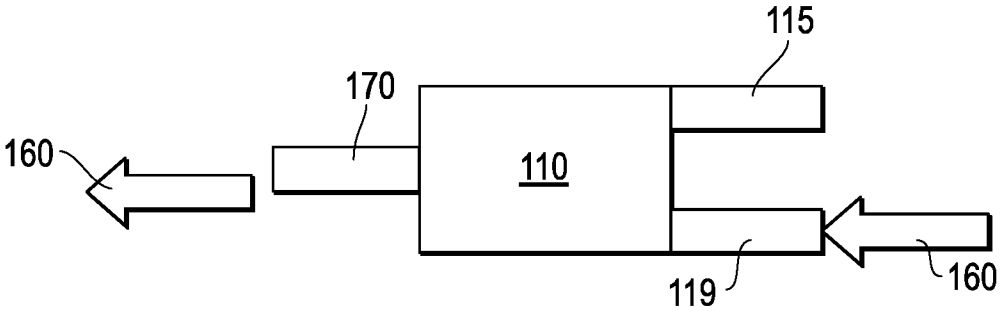
FIG. 3B is a schematic view of the downhole coupler of FIG. 2 for routing of data uphole.

With added reference to FIG. 3B, the same advantages noted above are true of the downhole coupler 110. Thus, in addition to avoiding substantial signal losses through the couplers 101, 110, an effective optical margin may be enhanced and maintained over time. For example, as alluded to above, where natural attenuation occurs over the life of a fiber optic thread, such a system may be susceptible to losing capacity for effective communications. In theory this is due to crosstalk constituting an ever increasing amount of the signal detected given that this type of signal does not attenuate through a fiber optic thread 190 in a system 100 such as that of FIGS. 1 and 2. Thus, the optical margin may eventually be breached rendering communications ineffective. However, in the embodiments shown, WDM couplers 101, 110 may be utilized to help minimize signal losses and crosstalk therethrough. Additionally, the signals (i.e. 140, 160) are not split but substantially maintained across the couplers 101, 110. Thus, as indicated, the optical margin may be substantially maintained for a longer duration with effective communications enhanced over the long term.

While the coupler embodiments 101, 110 depicted in FIGS. 3A and 3B highlight fiber optic routing therethrough, additional features and communication modes may be supported. For example, in an embodiment also utilizing electronic communications or power, such couplers 101, 110 may also manage such transmissions. Furthermore, the couplers 101, 110 may directly incorporate features such as the receiver and/or transmitter for sake of a more unitary device.

Figure 4:
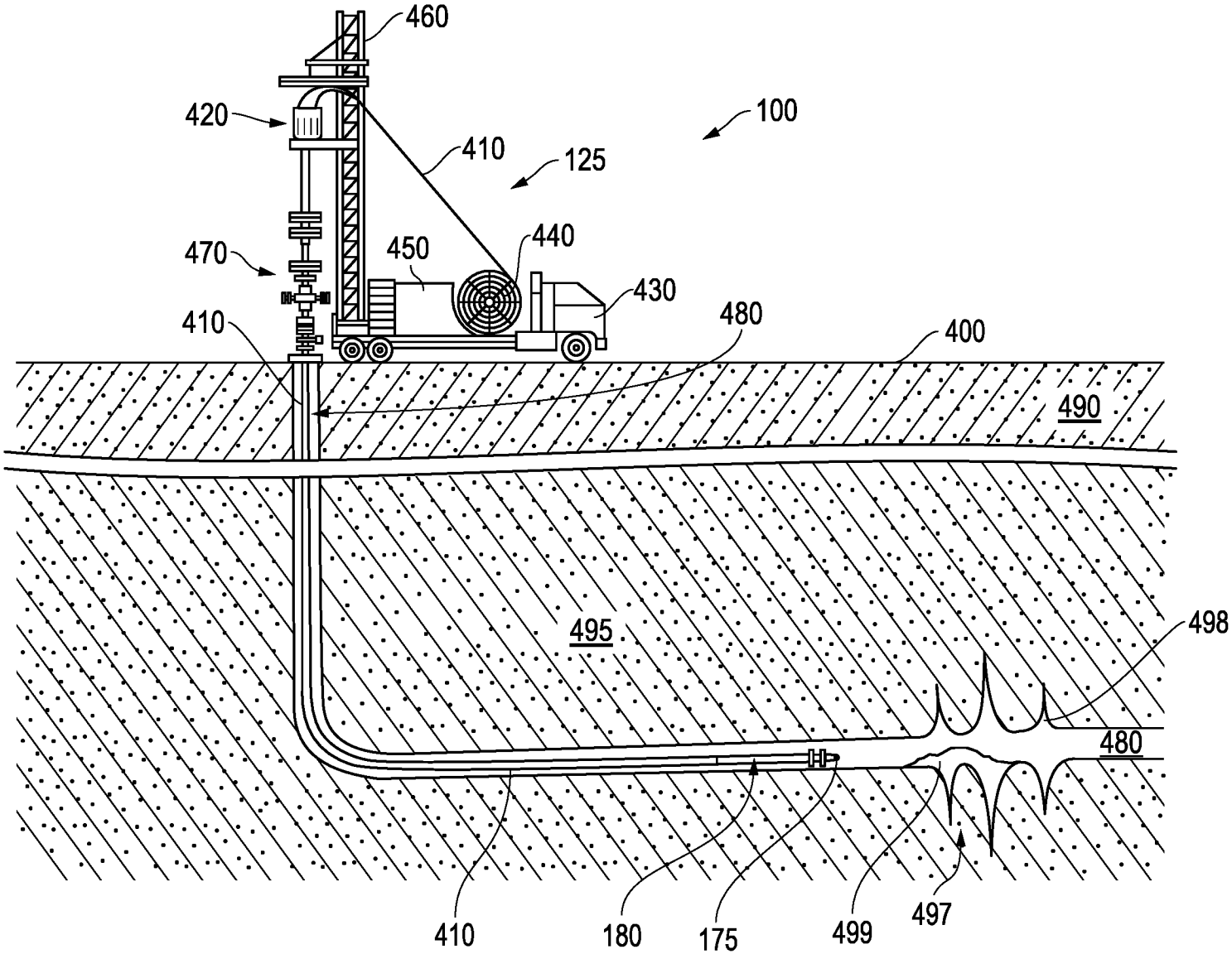
FIG. 4 is an overview of an oilfield accommodating a well with the coiled tubing system of FIG. 1 deployed therethrough with two-way telemetry.

Referring now to FIG. 4, an overview of an oilfield 400 accommodating a well 480 with the coiled tubing system 100 of FIG. 1 deployed therethrough is shown. As indicated above, the system 100 includes coiled tubing 410 running from equipment 125 at the oilfield 400 that includes two-way telemetric communications over a single fiber optic thread 190 as shown in FIGS. 1 and 2. With further added reference to FIG. 1, the system 100 includes an uphole assembly 150 with surface equipment 125 that is linked to a downhole assembly 180 with an application tool 175. In the embodiment shown, the application tool 175 is a cleanout tool, for example, directed at debris 499. The tool 175 may be directed by a control unit 450 to effect debris removal and leave perforations 498 at a production region 497. Further, with two-way communications available, the tool 175 may also provide feedback information back to the control unit 450, for example, regarding the application, tool, well conditions, or other downhole information.

Continuing with reference to FIG. 4, the noted two-way communications may take place over a single fiber optic thread 190 of minimal profile as shown in FIGS. 1 and 2. Thus, clearance within the coiled tubing 410 may be sufficient for fluid flow capable of maintaining integrity of the coiled tubing 410 as well as delivering fluid for the cleanout of the indicated debris 499. Additionally, in such an embodiment the fiber optic nature of communications may be less susceptible to damage where the cleanout fluid is of an acid nature.

As shown in FIG. 4, the surface equipment 125 includes a mobile coiled tubing truck 430 carrying a reel 440 of tubing 410 that is supported by a mobile rig 460 and forcibly driven through a pressure control system 470 by a conventional gooseneck injector 420. In this way, the coiled tubing 410 and application tool 175 may be advanced several thousand feet through the well 480 traversing multiple formation layers 490, 495 before reaching the targeted application site. Nevertheless, the single thread nature of the two-way communications provided through the coiled tubing 410 may help to keep the total weight of the deployed tubing 410 to a minimum as well as the cost. That is, in place of multiple threads for two-way communications through the coiled tubing 410, a single thread may be utilized as detailed above.

With added reference to FIGS. 1 and 2, use of a single thread 190 means that there is also an added degree of reliability in the communications due to the reduced number of terminations. Specifically, while four or more terminations may be utilized in a conventional multi-thread embodiment, fiber optic terminations may be reduced to as few as two in single thread embodiments described herein (i.e. with one termination at each of the common fittings 130, 170). However, in other embodiments, the fiber optic thread 190 may be interrupted with a fiber optic rotating joint, for example, at the coiled tubing reel 440 or downhole so as to allow for flexibility in movement during deployment of the coiled tubing 410.

In other embodiments, additional fiber optic threads may be utilized beyond the two-way communication thread 190 running through the coiled tubing 410. For example, a fiber optic thread dedicated to acquiring passive distributed readings such as, but not limited to, DTS readings, for relay to the control unit 450 may be incorporated into the system 100. Nevertheless, these communications remain fiber optic in nature. Thus, not only is the weight kept to a minimum which is particularly beneficial over the span of several thousand feet, but this also means that the equipment interfaces may remain of single type. That is, the surface equipment 125 may utilize consistent fiber optic interfacing for all communications and not require dedicated fiber optic interface for some communications while requiring alternative circuitry for other communication types.

With the above in mind, in yet another embodiment, the surface coupler 101 may be provided with a third channel for accommodating this added DTS (or similar distributed measurement) thread. In this embodiment, this added dedicated DTS thread may be employed as opposed to utilizing the two-way communication thread 190 of FIGS. 1 and 2 to acquire such readings. In this way, communications to the surface may all be of the uplink variety (i.e. 160) from the downhole assembly 180, free of any other fiber optic data running uphole. However, in other embodiments, the fiber optic thread 190 may also be utilized for acquiring such data without the reliance on a separate dedicated thread to acquire and relay such data.

Figure 5:
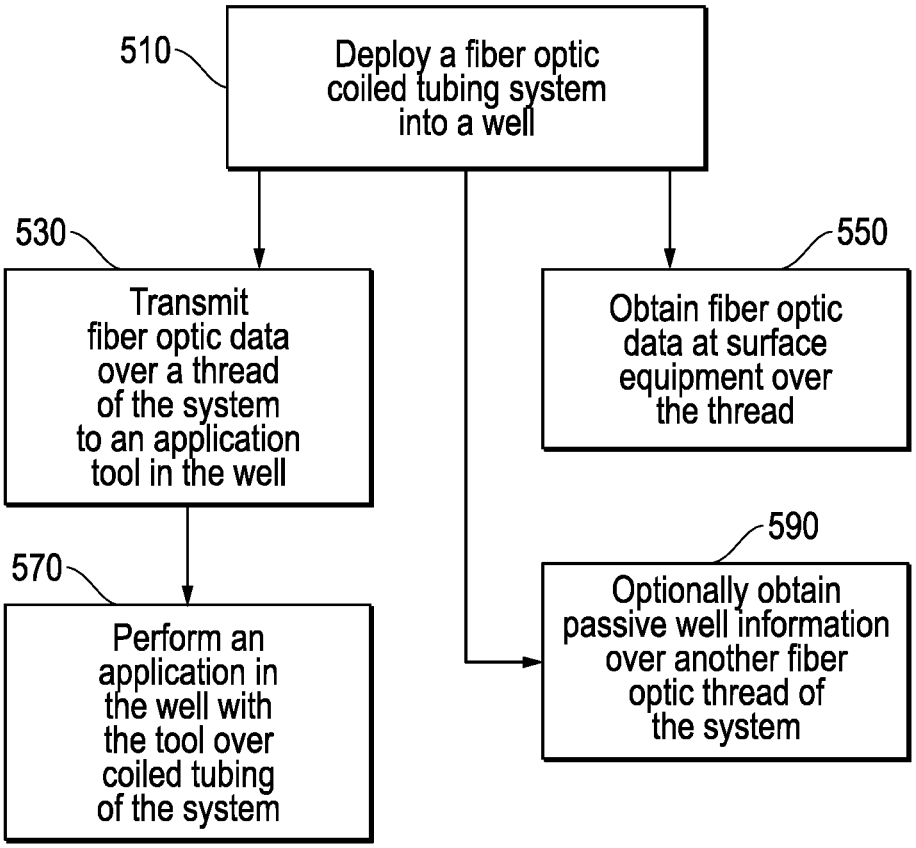
FIG. 5 is a flow-chart summarizing an embodiment of utilizing a system with a single fiber optic thread therethrough for telemetry during a coiled tubing application.

Referring now to FIG. 5, a flow-chart is shown summarizing an embodiment of utilizing a system with a single fiber optic thread therethrough for telemetry during a coiled tubing application. As indicated, coiled tubing of the system with fiber optic capacity may be deployed into a well (see 510). Thus, as indicated at 530, fiber optic data may be transmitted over a thread to an application tool, generally at the end of the coiled tubing. At the same time, and over the same thread, fiber optic data may also be sent to surface equipment as indicated at 550. So, for example, information regarding the ongoing application (see 570) may be available in real-time at the surface along with potentially additional or other downhole information. Further, as indicated at 590, another fiber optic thread may be provided that is dedicated to obtaining and relaying back to surface other, perhaps more passive downhole information.

Embodiments of a telemetric coiled tubing system are detailed herein which allow for a practical, cost saving implementation. More specifically, two-way telemetry may be achieved over a single fiber optic thread running several thousand feet through a well during a coiled tubing application. Once more, the two-way communication substantially eliminates cross-talk and other issues that might render sharing a single fiber optic thread less reliable. Ultimately, this allows for two-way communications over a single thread in a cost-effective and reliable manner. Thus, the size and weight of the communication line through the coiled tubing may be kept to a minimum while allowing for high-speed two-way communication. Additionally, the cost of added threads may be avoided or opted for, such as to provide passive distributed readings, such as distributed temperature, distributed pressure, distributed vibration, distributed strain or the like, at the operator's own discretion. Ultimately, the operator now has a reliable and more cost effective option where two-way telemetry over a coiled tubing system is desired.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Regardless, the foregoing description should not be read as pertaining only to the precise structures described and shown in the accompanying drawings, but rather should be read as consistent with and as support for the following claims, which are to have their fullest and fairest scope.

We claim:

1. A system for use at an oilfield with telemetric capacity, the system comprising:

a coiled tubing system having:

coiled tubing;

a surface assembly with surface fiber optic transmitter, surface fiber optic receiver and surface coupler incorporated into a first single module-type package, the surface coupler having a common fitting disposed at an axial end of the surface coupler and configured to be secured to a single fiber optic thread, the surface fiber optic transmitter configured to transmit fiber optic data at a first wavelength, and the surface fiber optic receiver interfaced with a surface filter to reduce fiber optic detection of wavelengths other than a second wavelength;

a downhole assembly with downhole fiber optic transmitter, downhole fiber optic receiver and downhole coupler incorporated into a second single module-type package, the downhole coupler having a common fitting disposed at an axial end of the downhole coupler and configured to be secured to a single fiber optic thread, the downhole fiber optic transmitter configured to transmit fiber optic data at the second wavelength, and the downhole fiber optic receiver interfaced with a downhole filter to reduce fiber optic detection of wavelengths other than the first wavelength; and a single fiber optic thread running through the coiled tubing of the coiled tubing system for at least 10,000 feet, the single fiber optic thread being jacketed and coupled to each of the common fittings of the surface and downhole couplers at opposite ends of the single fiber optic thread for simultaneously transmitting fiber optic data from the surface fiber optic transmitter to the downhole fiber optic receiver and from the downhole fiber optic transmitter to the surface fiber optic receiver through the single fiber optic thread.

2. The system of claim 1 wherein each of the surface and downhole couplers is of a wavelength division multiplexing configuration.

3. The system of claim 1 wherein the surface coupler comprises a dedicated surface channel for receiving passive distributed temperature sensing (DTS) readings from downhole sensors.

4. The system of claim 1 wherein the surface coupler comprises:

a dedicated surface uplink channel for interfacing the surface fiber optic receiver; and a dedicated surface downlink channel for interfacing the surface fiber optic transmitter, the surface uplink and downlink channels for fiber optically interfacing within a body of the surface coupler.

5. The system of claim 1 wherein the downhole coupler comprises:

a dedicated downhole downlink channel for interfacing with the downhole fiber optic receiver; and a dedicated downhole uplink channel for interfacing with the downhole fiber optic transmitter, the downhole uplink and downlink channels for fiber optically interfacing within a body of the downhole coupler.

6. The system of claim 1 wherein the surface filter blocks the surface fiber optic receiver from detecting fiber optic data having the first wavelength.

7. The system of claim 1 wherein the first and second wavelengths are at least about 200 nm apart.

8. The system of claim 1 wherein the surface fiber optic receiver is tuned to detect the second wavelength of fiber optic data and the downhole fiber optic receiver is tuned to detect the first wavelength of fiber optic data.

9. The system of claim 1 wherein the downhole filter blocks the downhole fiber optic receiver from detecting fiber optic data having the second wavelength.

10. A telemetric system for supporting an application in a well at an oilfield, the system comprising:

surface equipment for positioning at a surface of the oilfield to direct the application;

a surface assembly coupled to the surface equipment, the surface assembly having a surface fiber optic transmitter, surface fiber optic receiver and surface coupler incorporated into a first single module-type package, the surface coupler having a common fitting disposed at an axial end of the surface coupler and configured to be secured to a single fiber optic thread, the surface fiber optic transmitter configured to transmit fiber optic data at a first wavelength, and the surface fiber optic receiver interfaced with a surface filter to reduce fiber optic detection of wavelengths other than a second wavelength;

a downhole tool for performing the application in the well;

a downhole assembly coupled to the downhole tool and having a downhole fiber optic transmitter, downhole fiber optic receiver and downhole coupler incorporated into a second single module-type package, the downhole coupler having a common fitting disposed at an axial end of the downhole coupler and configured to be secured to a single fiber optic thread, the downhole fiber optic transmitter configured to transmit fiber optic data at the second wavelength, and the downhole fiber optic receiver interfaced with a downhole filter to reduce fiber optic detection of wavelengths other than the first wavelength;

coiled tubing running from the surface equipment to the downhole tool with a single fiber optic thread therethrough coupled to each of common fittings of the surface and downhole couplers at opposite ends of the single fiber optic thread to support simultaneous two-way communication between the downhole tool and the surface equipment through the single fiber optic thread, the single fiber optic thread being jacketed and having a high temperature rating of at least 150° C.

11. The system of claim 10 wherein the single fiber optic thread is further configured to acquire and relay passive distributed data to the surface fiber optic receiver.

12. The system of claim 10 wherein the single fiber optic thread is a first thread, the system further comprising a second fiber optic thread running through the coiled tubing and coupled to the surface coupler; wherein the second fiber optic thread supports acquisition of passive distributed data for relay to the surface fiber optic receiver.

13. The system of claim 10 further comprising a fiber optic rotating joint located at the fiber optic thread between the surface and downhole assemblies.

14. The system of claim 10 wherein the surface equipment comprises a control unit for directing the application over the single fiber optic thread based on fiber optic data obtained from the downhole tool over the single fiber optic thread.

15. A method of performing a coiled tubing application in a well, the method comprising:

deploying coiled tubing into a well;

transmitting fiber optic data having a first wavelength from a surface assembly at an oilfield to a downhole fiber optic receiver of a downhole assembly coupled to the coiled tubing over a single fiber optic thread through the coiled tubing, wherein the surface fiber optic receiver is interfaced with a surface filter to reduce fiber optic detection of wavelengths other than a second wavelength;

obtaining fiber optic data having the second wavelength at the surface assembly over the single fiber optic thread from the downhole assembly, wherein transmitting and obtaining are performed simultaneously through the single fiber optic thread, wherein the downhole fiber optic receiver is interfaced with a downhole filter to reduce fiber optic detection of wavelengths other than the first wavelength; and connecting the single fiber optic thread with a wavelength division multiplexing (WDM) surface coupler and a WDM downhole coupler via common fittings disposed at axial ends of the surface coupler and the downhole coupler at opposite ends of the single fiber optic thread to reduce signal losses, wherein the WDM surface coupler and the WDM downhole coupler are each incorporated into single module-type packages, wherein the common fittings are each configured to be secured to only a single fiber optic thread.

16. The method of claim 15 further comprising obtaining passive distributed data at the surface assembly over the single fiber optic thread.

17. The method of claim 15 further comprising performing the application in the well with a tool coupled to the coiled tubing; wherein the application is performed based on the fiber optic data transmitted from the surface assembly to the downhole assembly.

18. The method of claim 17 wherein the fiber optic data transmitted from the surface assembly to the downhole assembly is based on fiber optic data acquired from the downhole assembly by the surface assembly.

19. The method of claim 15 wherein the single fiber optic thread is a first fiber optic thread, the method further comprising acquiring downhole fiber optic data at the surface assembly from a second fiber optic thread.

20. The method of claim 19 wherein the downhole fiber optic data acquired is passively acquired from the second fiber optic thread.

* * * * *